US006929234B2

(12) United States Patent
Takagi

(10) Patent No.: US 6,929,234 B2
(45) **Date of Patent: *Aug. 16, 2005**

(54) TILT-UP CONSTRUCTION CHAMFERS

(75) Inventor: Kyozaburo Takagi, Centerville, OH (US)

(73) Assignee: Fukuvi USA, Inc., Huber Heights, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/738,193

(22) Filed: Dec. 17, 2003

(65) Prior Publication Data

US 2004/0124333 A1 Jul. 1, 2004

Related U.S. Application Data

(63) Continuation of application No. 09/918,965, filed on Jul. 31, 2001, now Pat. No. 6,702,247.

(51) Int. Cl.[7] ..... E04G 9/02; B28B 7/08

(52) U.S. Cl. ..... 249/189; 249/219.1; 52/127.3; 52/742.14; 52/699

(58) Field of Search ..... 52/127.3, 742.14, 52/699, 293.3, 730.6, 745.09; 249/188–189, 219.1, 205, 177

(56) References Cited

U.S. PATENT DOCUMENTS

| | | | |
|---|---|---|---|
| 1,846,196 | A | 2/1932 | Goldsmith |
| 2,858,583 | A | 11/1958 | McEvoy et al. |
| 2,940,152 | A | 6/1960 | Riehl |
| 2,953,835 | A | 9/1960 | Armstrong et al. |
| 2,985,938 | A | 5/1961 | Rappas |
| 3,782,680 | A | 1/1974 | Hopkins |
| 4,042,205 | A | 8/1977 | Herrell |
| 4,183,497 | A | 1/1980 | Tamez |
| 4,387,535 | A | 6/1983 | Corbo |
| 5,205,942 | A | 4/1993 | Fitzgerald |
| 5,377,447 | A | 1/1995 | Fritch |
| 5,397,096 | A | 3/1995 | Nelson |
| 5,562,272 | A | 10/1996 | McAbee et al. |
| 5,616,271 | A | 4/1997 | Podgurski |
| 5,656,194 | A | 8/1997 | Zimmerman |
| 5,671,571 | A | 9/1997 | Braun |
| 6,322,045 | B1 | 11/2001 | Andros |
| 6,398,180 | B1 | 6/2002 | Eyring et al. |
| 6,702,247 | B2 | 3/2004 | Takagi et al. |
| 2003/0025235 | A1 | 2/2003 | Takagi et al. |
| 2003/0115816 | A1 | 6/2003 | Dodson et al. |
| 2004/0000626 | A1 | 1/2004 | Takagi et al. |
| 2004/0046100 | A1 | 3/2004 | Takagi et al. |

FOREIGN PATENT DOCUMENTS

| | | |
|---|---|---|
| DE | 3638537 | 5/1988 |
| EP | 128626 | 12/1984 |

*Primary Examiner*—Winnie Yip
(74) *Attorney, Agent, or Firm*—Dinsmore & Shohl LLP

(57) ABSTRACT

A chamfer for securing precast concrete wall panel forms that are used in tilt-up construction. The chamfer includes an elongate base portion and at least one chamfer portion coextensive with the lengthwise direction of the elongate base portion. The base portion defines a substantially horizontal base plane. The chamfer portion includes a first leg disposed upstanding relative to the base portion, and a second leg portion angularly disposed relative the first leg. The second leg further includes at least one flexible edge that projects beyond at least the base plane or the plane defined by the lengthwise direction extension of the first leg. Depending on which part of the second leg the edge is cantilevered from, it forms a sealed relationship between the chamfer and a casting surface, the chamfer and a plank used as part of the wall form, or both. The application of weight, usually due to the addition of a plank, causes the base portion of the chamfer to flex, which in turn causes the flexible edges disposed on the chamfer outside the elastic curve defined by the flexed base portion to splay, and edges disposed on the chamfer inside the elastic curve to pinch, thereby effecting a seal to minimize or eliminate leakage associated with the poured concrete.

5 Claims, 4 Drawing Sheets

TILT-UP CONSTRUCTION CHAMFERS

CROSS-REFERENCE TO RELATED APPLICATIONS

This application is a continuation of U.S. patent application Ser. No. 09/918,965, filed Jul. 31, 2001, now U.S. Pat. No. 6,702,247.

BACKGROUND OF THE INVENTION

Tilt-up (or precast) construction of concrete wall sections is well-known in the art. In such an approach, forms are placed edgewise on a flat casting surface, and filled with concrete, which is then cured. Once the concrete has set, the form is removed and the wall is tilted up into the preferred, typically vertical, orientation. Most forms are made of conventional wood planks, such as two-by-eights and the like. To keep the forms from shifting during the form assembly portion of the operation, as well as to provide smooth, beveled edges to the finished concrete slab, single or double chamfers have been employed. These chamfers are often in the shape of a triangle with an extended base for plank edge support (in the case of the single chamfer variant), or a trapezoidal member with a plank-engaging channel disposed in the center (the dual chamfer variant). When placed in the chamfer, the vertically extending widthwise dimension of the plank defines the thickness of the concrete wall panel to be poured. The chamfer is placed to engage every plank that makes up the form.

One problem associated with conventional chamfer construction is the tendency of the poured concrete to leak into gaps prior to drying and hardening. This problem is especially acute between the chamfer and the casting surface, and between the chamfer and the plank, as the resulting dried portion that has leaked through can stick to the chamfer, which can in turn lead to an unintended, cost-prohibitive one-time chamfer use. In addition, if the dried concrete that has leaked through bonds to the finished product wall section and subsequently breaks off during handling, the bond might be strong enough to take portions of the finished product with it, thus adversely effecting the quality of the finished product. Prior art attempts at providing a seal to preclude the occurrence of leaking have been of a passive nature in that the chamfer relies on a close fit to accept a plank of standard thickness without gaps, but does nothing to actively close plank-to-chamfer gaps. In addition, no attempts have been made to provide seals between the chamfer and the casting surface.

Accordingly, there exists a need for a device that can ensure that tilt-up wall panels are precast with a minimum amount of poured concrete bleed-through, thereby avoiding frame-chamfer bonding and subsequent difficulty in separating the two.

SUMMARY OF THE INVENTION

The need is met by the present invention, which comprises a sealing chamfer used to support tilt-up wall panels without the disadvantages of the prior art. According to a first aspect of the present invention, a chamfer for engaging a plank to form concrete wall panels for tilt-up construction is disclosed. The chamfer, which includes a base portion, at least one chamfer portion, and a plank-accepting portion defined by adjacent cooperation of the base and chamfer portions, is configured for substantially horizontal placement upon a casting surface, such as a smooth floor. As such, it can accept a form, preferably made of individual wood planks secured together, which can be coupled to the chamfer to produce a mold capable of accepting poured concrete. The base portion defines a base plane, and is elongate along a lengthwise direction and terminates in a pair of lateral edges that project along a widthwise direction. Both the upper and lower surfaces of the base portion are substantially flat. Each chamfer portion is disposed along one of the pair of lateral edges of the base portion and is substantially coextensive therewith along the base portion's lengthwise direction. Each chamfer portion defines a generally triangular shaped structure (when viewed end-on) made up of a normal leg disposed normal to the base portion to define a normal leg plane and an angular leg angularly disposed relative the normal leg. The angular leg additionally defines at least one flexible edge that projects beyond at least one of the base plane or the normal leg plane. As a result, when the chamfer includes a flexible edge that projects beyond the base plane, and is placed on a substantially flat casting surface, the substantially flat lower surface of the chamfer's base portion does not contact the casting surface. The gap formed by this configuration permits a certain amount of flexure in the chamfer when a load is applied. This flexure allows these cantilevered flexible edges of the chamfer portion to move in response to the base portion such that when the base portion flexes under a load (such as the placement of a plank in the plank-accepting portion), the fit between the flexible edges and an abutting surface, such as a plank or casting surface, is enhanced, thereby minimizing or eliminating the leakage of the poured concrete to areas outside the preconfigured mold volume. As used in conjunction with the present disclosure, the term "substantially" refers to an arrangement of elements or features that, while in theory would be expected to exhibit exact correspondence or behavior, may, in practice embody something slightly less than exact. For example, in the present context, even if the chamfer portion is cut short near the ends of the chamfer to facilitate the right-angled joining of two or more chamfers, the extension of the chamfer portion is still "substantially coextensive" with the elongate base portion under the present definition. By way of another example, a portion need not project perpendicularly out of a horizontal plane to be considered "substantially upstanding" as long as it points in a generally upward direction.

Optionally, a pair of flexible edges can be configured to extend from each angular leg such that one of the flexible edges projects beyond the base plane, while the other projects beyond the normal leg plane. An additional option includes having the one or more flexible edges be cooperative with the base portion such that, upon application of a load to the base portion, the base portion flexes to effect a sealed relationship between the one or more flexible edges and the casting surface, plank or both. The one or more chamfer portions may further comprise a cantilever leg that extends angularly from the angular leg and is disposed coplanar with the base portion. Moreover, the chamfer can be made of plastic, such as polyvinyl chloride (PVC). The use of such materials is beneficial in that, in addition to being inexpensive to produce (such as by extrusion, where long, continuous pieces can be made and cut to desired lengths), they are fracture-resistant as well as relatively non-stick, so that what little dried concrete residue remains after each use can be easily removed, thus prolonging the useful life of the chamfer. By virtue of the continuous-production nature of PVC and related materials, the chamfer and base portions can optionally comprise one piece, thus obviating separate joining steps.

According to another aspect of the invention, a chamfer includes a base portion and a pair of chamfer portions disposed along the base portion's widthwise lateral edges. The dual chamfer configuration is similar to that of the previous embodiment, with the exception that both widthwise edges of the base portion have a chamfer portion disposed along them. Accordingly, the plank-accepting portion is now defined by a channel, formed on the bottom by the base portion, and on the sides by the opposed upstanding normal legs of the chamfer portion pair. As before, the chamfer portion extends substantially the entire length of the base portion's elongate dimension. The lower surface of the base portion is configured to not engage with the casting surface until an application of a load on the chamfer. As with the previous embodiment, in one option, the at least one flexible edge can be a pair of flexible edges configured to extend from each angular leg such that one of the flexible edges projects beyond the base plane, while the other projects beyond the normal leg plane. An additional option includes having the one or more flexible edges be cooperative with the base portion such that, upon application of a load to the base portion, the base portion flexes to effect a sealed relationship between the one or more flexible edges and the casting surface, plank or both.

According to another aspect of the present invention, a method of forming a precast wall panel for tilt-up construction is disclosed. The method utilizes one or more chamfers that are configurationally similar to that of the previous embodiments, in that each chamfer is made up of a base portion and a chamfer portion which together define a plank-accepting portion, and may be either of the single or double chamfer variants, as previously discussed. The chamfer portion itself is made up of at least a normal leg and an angular leg, and the angular leg further includes at least one projecting flexible edge. The method includes placing one or more chamfers on a casting surface, arranging the one or more chamfers to accept a form, placing the form into the plank-accepting portion of the one or more chamfers, pouring concrete into a mold defined by the chamfer and the form; and curing the concrete. The configuration of the chamfer of the present invention is such that the weight of the planks in the form causes any projecting flexible edge on the outer part of the chamfer radius of curvature to splay, and any projecting flexible edge on the inner part of the chamfer radius of curvature to pinch, thereby effecting a tight fit between adjacent surfaces of the chamfer, casting surface and plank to prevent or minimize poured concrete leakage. Optionally, an additional step to the method may include securing the chamfer to the casting surface. This may be accomplished in any number of conventional joining or fastening techniques.

DETAILED DESCRIPTION OF THE PREFERRED EMBODIMENTS

Figure 1B:
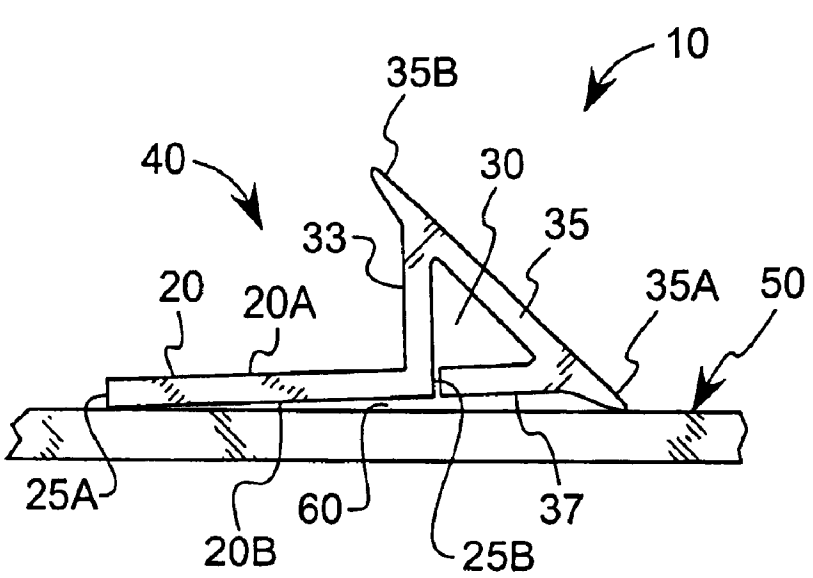
FIG. 1B is an end view of a single chamfer according to an embodiment of the present invention.
Figure 1A:
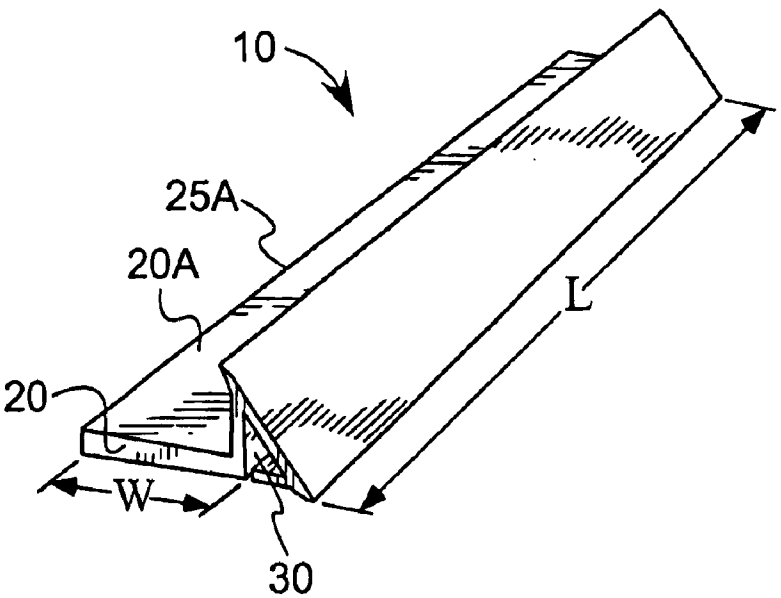
FIG. 1A is a perspective view of a single chamfer according to an embodiment of the present invention.

Referring first to FIGS. 1A and 1B, a chamfer 10 including a base portion 20 and a chamfer portion 30 is shown. The base portion 20 defines as a base plane the plane that extends in a generally horizontal fashion from the edges of the base portion along lines defined by the base portion's top and bottom surfaces 20A and 20B, respectively. The generally triangular-shaped chamfer portion 30 is disposed along one of two lateral edges 25A, 25B of base portion 20, and is substantially coextensive with the elongate lengthwise dimension L of the base portion 20. As shown particularly in FIG. 1B, the chamfer portion 30 extends from lateral edge 25B, and includes a normal leg 33, an angular leg 35 and an optional cantilever leg 37. The base portion 20 and chamfer portion 30 cooperate to define a plank-accepting portion 40. In its preferred orientation, chamfer 10 rests substantially horizontally on a casting surface 50, which is preferably a smooth floor or similar tilt-up wall assembly space. Angular leg 35 is further defined by one or more flexible edges 35A, 35B. The flexible edge 35A projects beyond the base plane defined by the base portion 20 so that, when chamfer 10 is placed on casting surface 50, the only contact between them occurs at the lateral ends, as a gap 60 is formed between the substantially flat lower surface 20B and casting surface 50. Likewise, flexible edge 35B projects beyond the normal plane defined by normal leg 33 such that a plank (not shown in FIGS. 1A and 1B) inserted into plank-accepting portion 40 contacts chamfer portion 30 predominantly at the tip of flexible edge 35B.

Figure 2A:
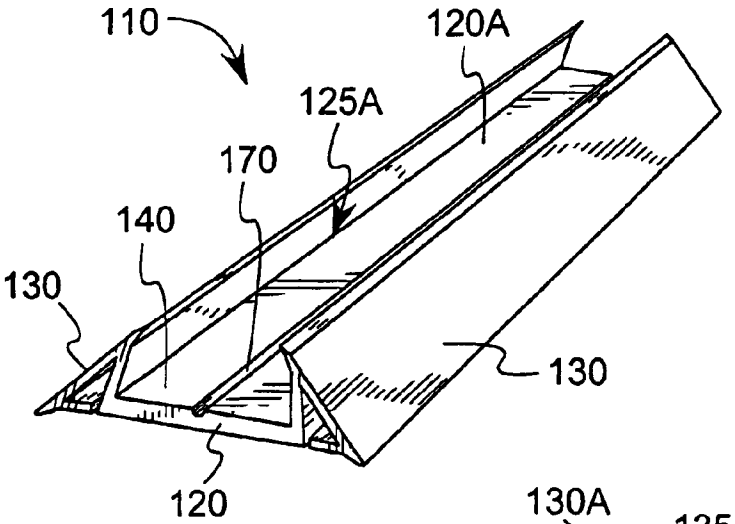
FIG. 2A is a perspective view of a double chamfer according to an embodiment of the present invention.
Figure 2B:
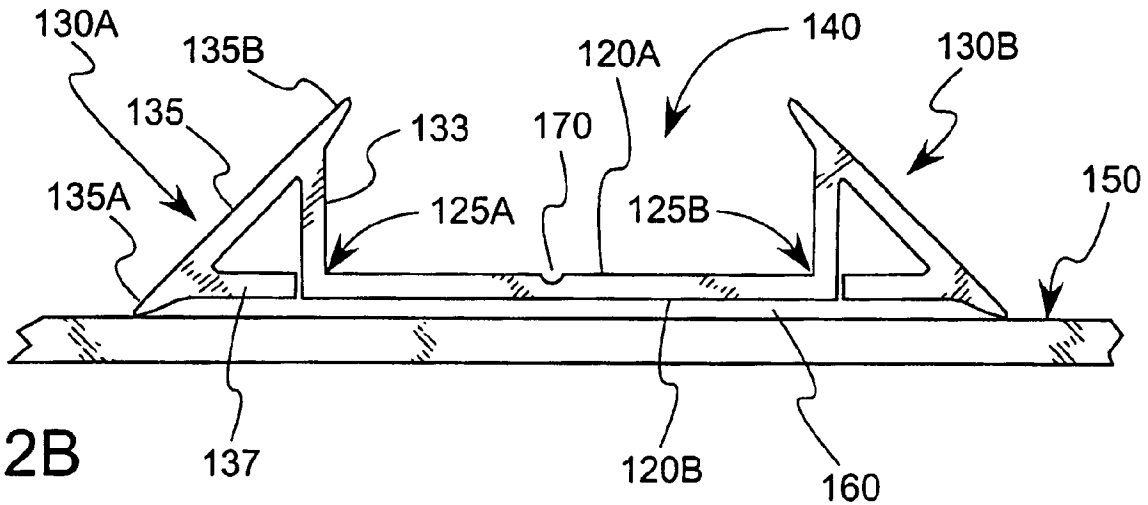
FIG. 2B is an end view of a double chamfer according to an embodiment of the present invention.

Referring now to FIGS. 2A and 2B, a chamfer 110 including a base portion 120, chamfer pair portion 130, and a plank-accepting portion, defined by channel 140, formed between the chamfer pair portions 130A, 130B and the upper surface 120A of base portion 120, is shown. Each of the generally triangular-shaped chamfer pair portions 130A, 130B are disposed along a lengthwise edge 125A, 125B of the base portion 120. The width of the channel 140 is such that a plank can fit snugly therein when placed in edgewise. As with the previous embodiment, the chamfer 110 construction is such that flexible edges 135A, 135B project from one or both ends of the angular leg 135 so that when the chamfer 110 is placed on a generally flat surface, such as a casting surface 150, a gap 160 is formed such that the lower surface 120B of base portion 120 does not contact the casting surface 150 until a downward-acting load (such as due to the weight of an inserted plank, discussed in more detail below) causes the chamfer 110 to flex. A groove 170, centrally-disposed in the upper surface 120A of base portion 120 may optionally be added to promote flexure of the chamfer 110.

As clearly shown in FIG. 2B, each projecting flexible edge 135A defines at its terminus a discrete contact surface that engages the casting surface 150. The discrete contact surface illustrated in FIG. 2B is a result of the relatively small total surface area at the terminus of the flexible edge 135A. As is also clearly shown in FIG. 2B, the casting surface 150 and discrete contact surfaces defined by the flexible edges of each chamfer portion 130A, 130B lie in a common plane which may be referred to as the casting surface contact plane. Respective discrete contact surfaces are also defined by each projecting flexible edge 135B. Likewise, the single chamfer variant shown in FIGS. 1A and 1B highlights the discrete contact surface of the projecting flexible edges 35A, 35B. In both variants, there exists a reduced contact area between the chamfer and the casting surface.

Figure 3:
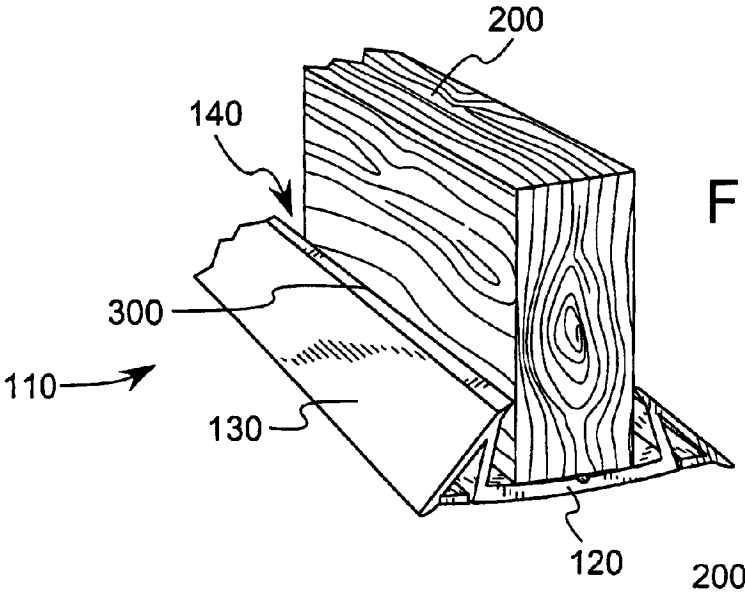
FIG. 3 is a perspective view of the double chamfer of FIG. 1A with a wooden plank disposed therein.
Figure 4:
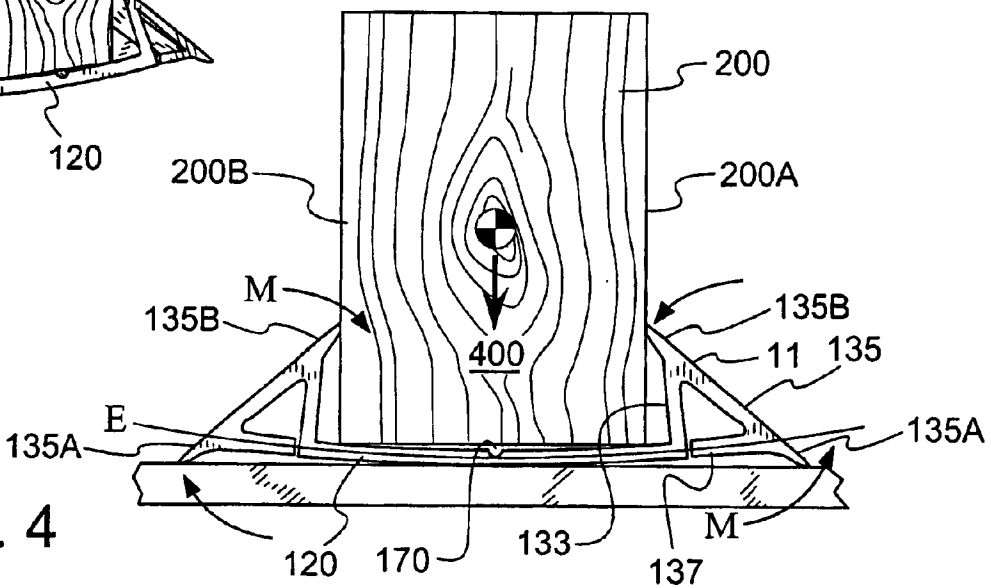
FIG. 4 is an end view of the double chamfer with plank of FIG. 3, showing the tendency of the outer radius of curvature flexible edges to splay and the inner radius of curvature flexible edges to pinch under a load.

Referring now to FIGS. 3 and 4, a plank 200 is shown inserted into channel 140 of the chamfer of FIG. 2. As shown in particularly in FIG. 3, the chamfer is sized such that a close fit 300 between the plank and the chamfer 110 is ensured. By being sized to fit closely with the dimensions of plank 200, the amount of flexure that chamfer 110 needs to go through is kept to a minimum, so that dimensional tolerances of the form and resulting cast wall remain tight. Turning particularly now to FIG. 4, the flexure of a dual chamfer 110 according to one of the previous aspects of the present invention is shown. When a load is applied (shown in the figure as due to the weight of plank 200), a downward-acting force 400 causes the base portion 120, which under a nonloaded condition does not contact casting surface 150, to flex. In this loading scenario, the chamfer 110 acts like a beam, and includes a radius of curvature corresponding to the magnitude of the force 400 and the constraints placed on chamfer flexure by the casting surface 150. Neutral bending plane (also known as the elastic curve) EE defines the radius of curvature in that the radius of curvature along any point on the elastic curve EE is equal to the radius of a circle with a circumference that conforms to the elastic curve's shape at that point. Under the bending caused by force 400, a moment M is set up in the two chamfers 110, which causes the flexible edges 135B disposed on the inner part of the radius of curvature (i.e.: those disposed inward of the elastic curve EE) to crowd inward, thus producing a pinching effect on any surface they come in contact with, which, in the present invention is preferably surfaces 200A, 200B of plank 200. Likewise, the flexible edges 135A disposed on the outer part of the radius of curvature (i.e.: those disposed outside of elastic curve EE) tend to splay, thus producing a tighter frictional fit on the casting surface 150. The combined effect of the flexible edges is to produce a tighter frictional fit between the chamfer 110 and the casting surface 150 (in the case of flexible edges 135A), and between the chamfer 110 and the plank 200 (in the case of flexible edges 135B), thus reducing the likelihood of unwanted concrete buildup beyond the boundaries of the desired tilt-up wall shape.

Figure 5:
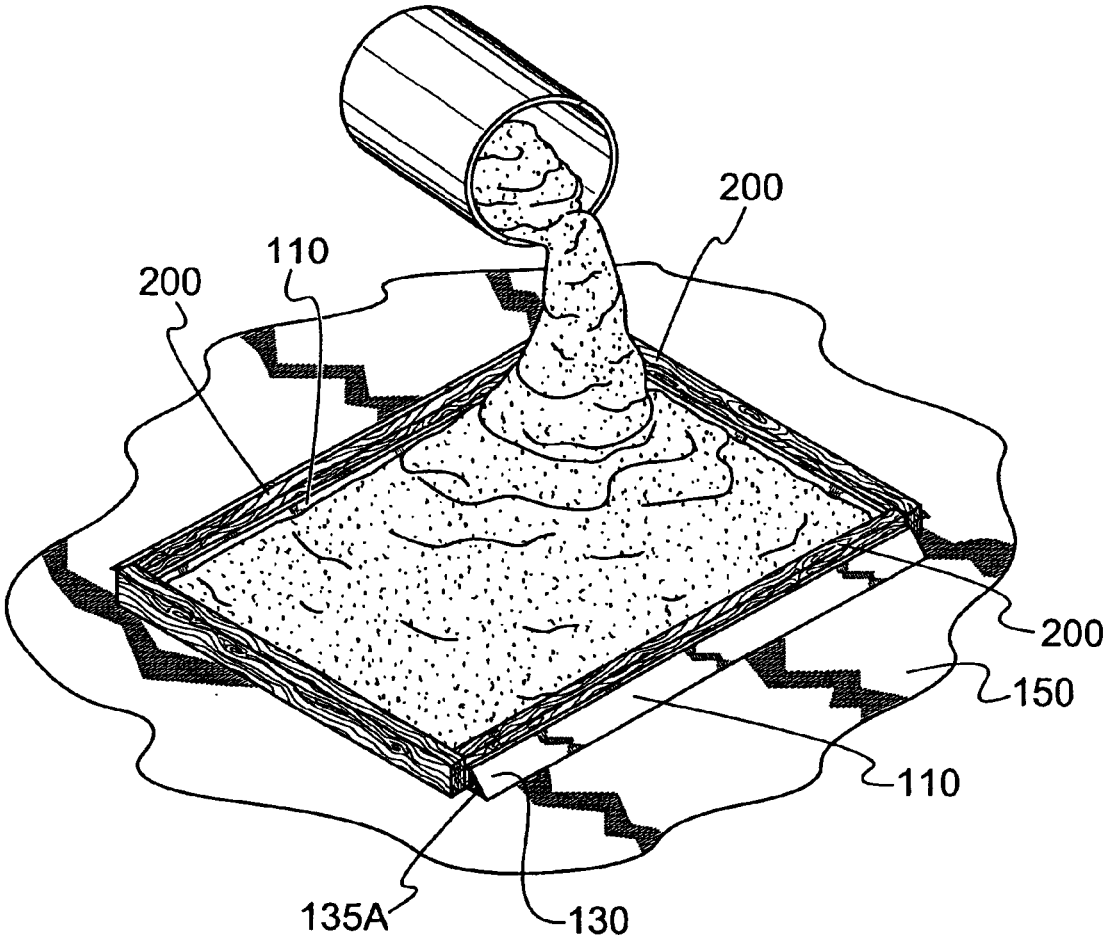
FIG. 5 is a perspective view showing the formation of a precast panel using the chamfer and plank of FIG. 3.

Referring next to FIG. 5 in conjunction with FIGS. 3 and 4, the preparation of a precast panel using a chamfer 110 according to an embodiment of the present invention is shown. Chamfer 110 is first placed on casting surface 150. As previously discussed, chamfer 110 can be secured to casting surface 150 by any suitable means. Next, plank 200 is placed within channel 140 of chamfer 110 at places along locations where a chamfered finish is desired. The weight of plank 200 causes chamfer 110 to flex. This in turn causes flexible edges 135A, 135B to move relative the casting surface 150 and plank 200, respectively, thereby forming seals to inhibit the flow of concrete (or other pourable, castable material) in between the plank 200, chamfer 110 and casting surface 150. Thereafter, the concrete can be poured into a mold formed by the planks 200 and chamfers 110, and allowed to cure.

Having described the invention in detail and by reference to preferred embodiments thereof, it will be apparent that modifications and variations are possible without departing from the scope of the invention which is defined in the appended claims.

What is claimed is:

1. A plank and chamfer assembly for forming one or more precast panels on a casting surface, said assembly comprising a chamfer and a plank configured to be disposed in said chamfer, wherein:

said chamfer comprises a base portion comprising an upper surface and a lower surface and a pair of lateral chamfer portions defining a unitary construction;

each of said pair of chamfer portions comprises a lower projecting edge disposed at a lower end of said chamfer portion and an upper projecting edge disposed at an upper end of said chamfer portion, said lower projecting edge defining a discrete contact surface for engaging said casting surface such that a gap is defined between said lower surface of said base portion and said casting surface, said upper projecting edge defining a discrete contact surface for engaging said plank; and said chamfer is configured such that, upon placement of said plank into said chamfer, said lower projecting edge on each of said pair of chamfer portions forms a seal with said casting surface and said upper projecting edge on each of said pair of chamfer portion forms a seal with said plank.

2. A plank and chamfer assembly as claimed in claim 1 wherein said pair of chamfer portions define substantially planar upper surfaces.

3. A plank and chamfer assembly as claimed in claim 1 wherein said gap defined between said lower surface of said base portion and said casting surface extends substantially the entire width of said lower surface of said base portion.

4. A plank and chamfer assembly as claimed in claim 1 wherein said chamfer is configured to flex upon placement of said plank into said chamfer.

5. A plank and chamfer assembly as claimed in claim 4 wherein said projecting edge on each of said pair of chamfer portions forms said seal with said casting surface upon flexion of said chamfer.

* * * * *